US006953116B2

(12) United States Patent
Verna et al.

(10) Patent No.: US 6,953,116 B2
(45) Date of Patent: Oct. 11, 2005

(54) STACKABLE TRAY HAVING PRESTRESSED SECTIONS

(75) Inventors: Donald Verna, Wixom, MI (US); Richard C. Kruyer, Grand Blanc, MI (US)

(73) Assignee: Pinckney Molded Plastics, Inc., Howell, MI (US)

( * ) Notice: Subject to any disclaimer, the term of this patent is extended or adjusted under 35 U.S.C. 154(b) by 134 days.

(21) Appl. No.: 10/397,165

(22) Filed: Mar. 26, 2003

(65) Prior Publication Data

US 2003/0205495 A1 Nov. 6, 2003

Related U.S. Application Data

(60) Provisional application No. 60/377,725, filed on May 3, 2002.

(51) Int. Cl.[7] ..... B65D 21/00
(52) U.S. Cl. ..... 206/507; 206/509; 220/609
(58) Field of Search ..... 220/623, 624, 220/609; 206/507, 518, 503, 509

(56) References Cited

U.S. PATENT DOCUMENTS 3,270,913 A * 9/1966 Bridenstine et al. ..... 206/507
3,379,339 A * 4/1968 Asenbauer ..... 206/506
3,870,151 A * 3/1975 Johnson ..... 206/507
3,917,108 A 11/1975 Thurman
4,106,624 A * 8/1978 Thurman ..... 206/507
4,402,408 A * 9/1983 Kreeger et al. ..... 206/507
4,993,554 A * 2/1991 Box ..... 206/507
5,460,292 A * 10/1995 Holman ..... 220/675
5,960,720 A 10/1999 Borland et al.
5,984,133 A 11/1999 Schutz
6,241,096 B1 6/2001 Littlejohn et al.
6,260,706 B1 7/2001 Koefelda
6,386,388 B1 5/2002 Overholt

* cited by examiner

*Primary Examiner*—Joseph C. Merek
(74) *Attorney, Agent, or Firm*—Young & Basile, P.C.

(57) ABSTRACT

A tray having prestress sections including a domed shaped bottom and a merchandising window. The window includes a surface parallel to the dome shaped bottom. When the tray is subjected to a load, the dome and the surface of the merchandising window become substantially planar. The front of the tray also includes vertically extending corners that are angled inwardly toward one another from an outer top end to an inner lower end when the tray is empty. When the tray is loaded, the corners deflect toward a vertically extending parallel relationship with respect to one another. The corners adjacent the rear of the tray are fixed relative to one another.

11 Claims, 7 Drawing Sheets

STACKABLE TRAY HAVING PRESTRESSED SECTIONS

CROSS-REFERENCE TO RELATED APPLICATIONS

This application claims the benefit of the provisional patent application 60/377,725 for a STACKABLE TRAY HAVING PRESTRESSED SECTIONS, filed on May 3, 2002, which is hereby incorporated by reference in its entirety.

FIELD OF THE INVENTION

The invention relates to multi-purpose reusable load-bearing trays and, more specifically, to trays adapted to be stackable in three positions.

BACKGROUND OF THE INVENTION

Plastic trays that are stackable and/or nestable can be desirable to maintain cargo such as material and/or products. However, existing trays are not as efficient as desired. Specifically, existing trays can deform under loading in an undesirable manner such that the tray appears to sag.

SUMMARY OF THE INVENTION

The present invention provides a tray including one side defining an opening such as a merchandising window. The tray can also include a domed bottom. The side of the tray defining the merchandising window can include a portion extending substantially parallel to the domed bottom. The structure of the portion and the domed bottom provide a prestressed section such that the arcuate domed bottom and the arcuate portion of the one side are flattened, or straightened when material and/or goods are loaded with respect to the tray and the tray does not sag.

The present invention also provides recessed corners on opposite sides of the merchandising window. Specifically, the walls of the tray on opposite sides of the merchandising window can be angled inwardly with respect to the opposite corners. When material and/or goods are received by the tray, the tray can be deflected such that the corners deflect with respect to the bottom of the tray and align to be generally perpendicular with the respective opposing corners.

The present invention provides a tray having a front, first side, a second side, a rear and a bottom. The front includes an opening positioned between first and second ends of the front. The bottom is shaped, at least partially, as a dome. When the tray is subjected to a load, the dome portion of the bottom is flattened.

The opening of the front can include a surface that extends parallel to the dome portion of the bottom. When the tray is empty, the surface can extend along an arched path corresponding to the profile of the dome. When the tray is subjected to a predetermined load, the surface of the opening can flatten out and define a plane. The rear can also include an opening. The opening of the rear can include a surface that is flat or planar when the tray is empty and when the tray is loaded.

The front is integrally formed with the first side at a first end of the front and is integrally formed with the second side at a second end. A first vertically extending corner can be defined between the first side and the front, and a second vertically extending corner can be defined between the second side and the front. The first and second corners can be initially angled outwardly toward one another from an outer top end to a lower inner end when the tray is empty. A third vertically extending corner can be defined between the rear and the first side, and a fourth vertically extending corner can be defined between the rear and the second side. A horizontal distance between the upper and lower ends of the third and fourth vertically extending corners can be the same when the tray is empty and when the tray is loaded.

The first and second sides can twist when the tray is subjected to a predetermined load. For example, top portions of the first and second corners can deflect with respect to the bottom of the tray when the tray is subjected to a load, moving closer to one another. On the other hand, the third and fourth corners are fixed rigidly with respect to the bottom to minimize any deflection under loads.

The dome defined by the bottom can be centered with respect to the tray bottom or can be positioned closer to the front. For example, the front can include a bottom portion that defines an arched surface when the tray is empty and a substantially planar surface when the tray is loaded. A bottom portion of the rear can define a substantially planar surface when the tray is empty and when the tray is loaded.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
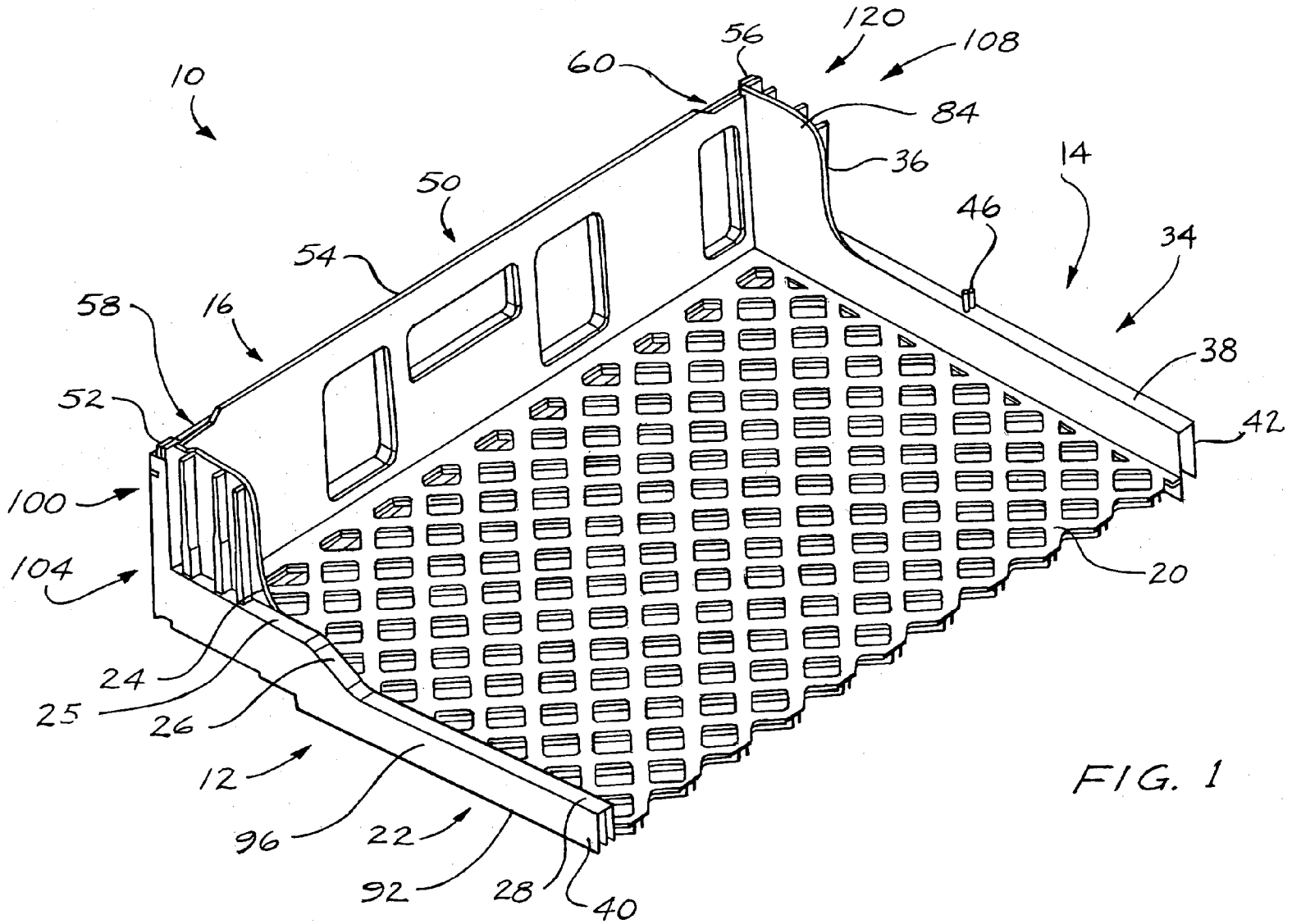
FIG. 1 is a partial perspective view of a top half of a tray according to the present invention.

The present invention is shown throughout the Figures. Some of the Figures include more than one tray according to the present invention, and in those Figures, different trays are designated with a common base numeral and differentiated with an alphabetic designation.

Referring now to FIGS. 1–5, the present invention provides a multi-purpose tray 10. The tray 10 can include a front 12, a rear 14, a first side 16, a second side 18, and a bottom 20. Each of these portions 12, 14, 16, 18 and 20 of the tray 10 can be integrally formed with respect to one another. The bottom 20 can extend in a transverse direction between the first side 16 and the second side 18 and in a longitudinal direction between the front 12 and the rear 14. The tray 10 can be fabricated from plastic in an injection molding process.

The front 12 can include an opening 22 defined by surfaces 24, 25, 26, 27, 28, 30, and 32. The surfaces 25, 26, 27, 28 and 30 can define a merchandising window. The rear 14 can include an opening 34 defined by surfaces 36 and 38. The opening 22 can be larger than the opening 34 to enhance the removal of material and/or products from the tray 10 from the front 12 and/or to enhance inspection of the material and/or products.

The front 12 and rear 14 can include walls 40 and 42, respectively, to enhance the structural integrity and/or rigidity of the tray 10. The wall 40 can include a rib 44 to enhance the structural rigidity of the front 12. Specifically, the wall 40 can be shorter than the wall 42, because of the merchandising window, and can be reinforced by the rib 44.

Figure 3:
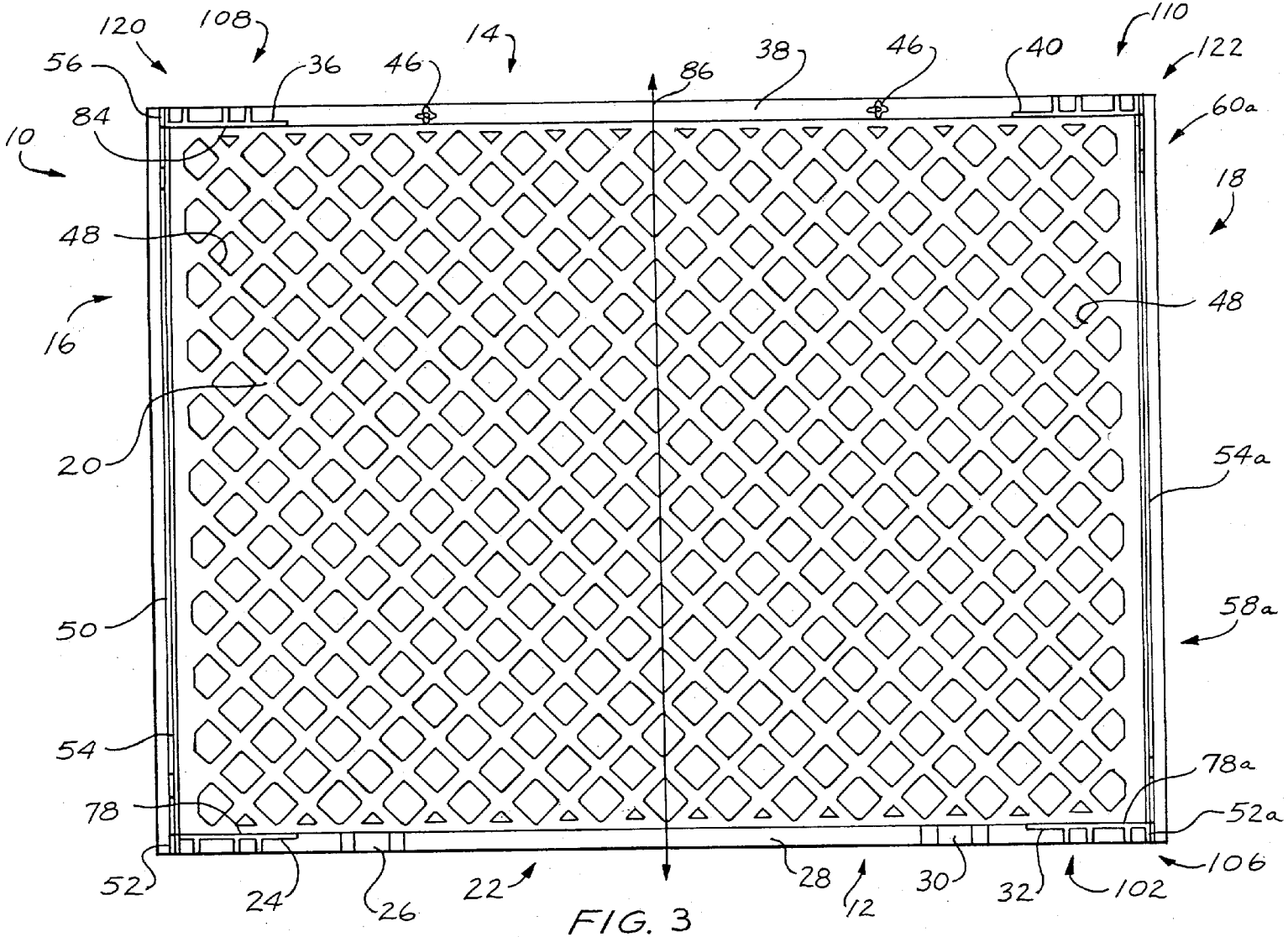
FIG. 3 is a top plan view of a tray according to the present invention.
Figure 6:
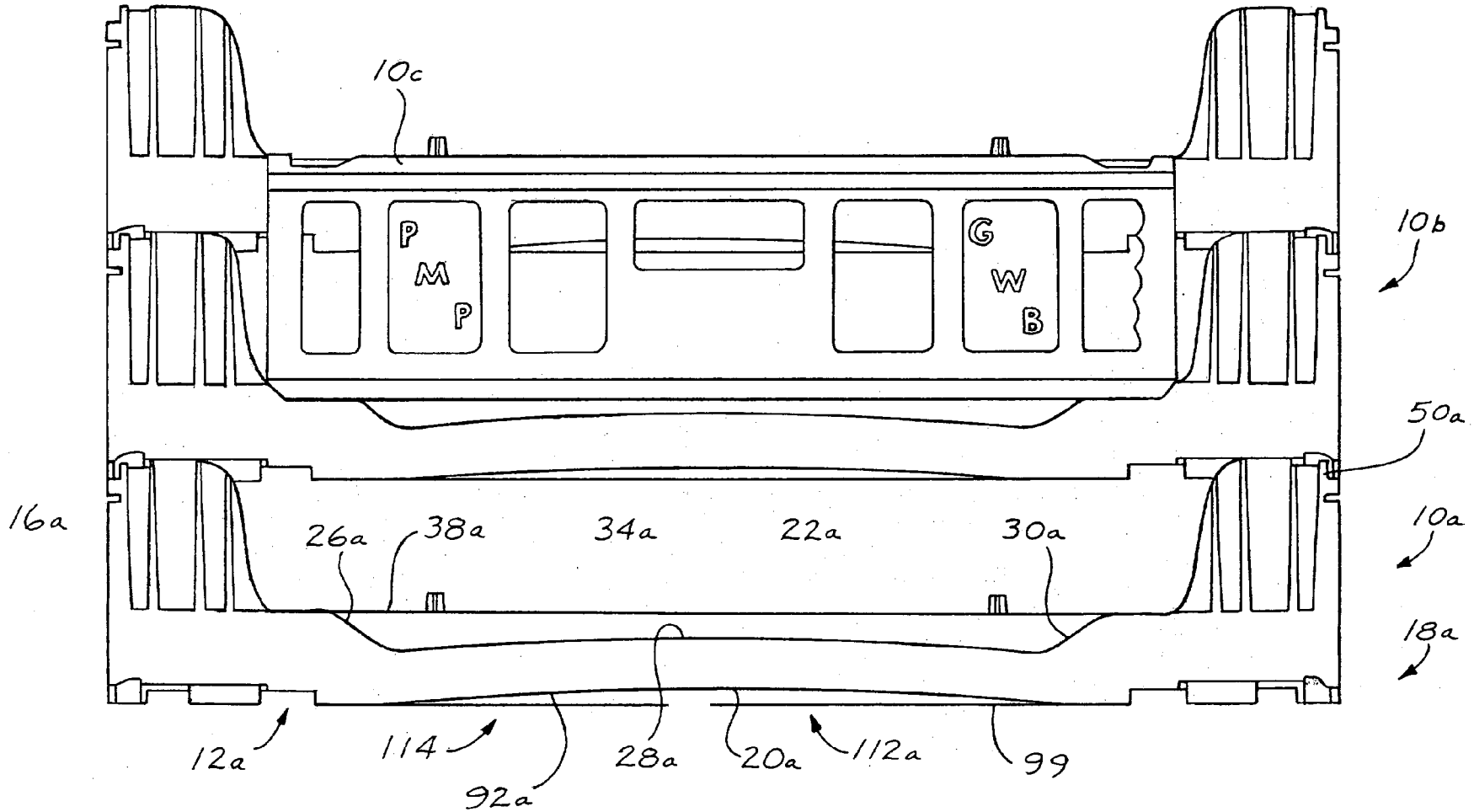
FIG. 6 is a front plan view of several trays stacked with respect to one another.

The rear 14 can also include one or more pins 46. When two trays are stacked at an angle of 180° relative to one another, the pins 46 can engage apertures 48 defined by the bottom 20. In FIG. 3, the apertures 48 are representative and may not indicate the precise aperture engaged by either of the pins 46. When the pin 46 is engaged with an aperture 48 of the bottom 20, movement of an upper tray relative to a lower tray is limited. FIG. 6 shows two trays 10*b* and 10*c* stacked at an angle of 180° relative to one another.

The first side 16 can be a mirror image of the second side 18 about an axis 86, best seen in FIG. 3. Both the first side 16 and the second side 18 can include a discontinuous runner 50 adjacent a top of the first side 16 and second side 18, respectively, for enhancing sliding engagement of two trays relative to one another. The runner 50 can include a front portion 52, a middle portion 54, and a rear portion 56. Each portion 52, 54, 56 is substantially longitudinally aligned with respect to one another. A first notch 58 can be disposed between the front portion 52 and the middle portion 54. A second notch 60 can be disposed between the middle portion 54 and the rear portion 56.

Each of the first side 16 and the second side 18 can also include a channel 62 defined in part by walls 64 and 66. The channel 62 can be disposed adjacent the bottom 20. Foot members 68 and 70 can be individually disposed at each end of the channel 62. One or more ribs 72 can be disposed along the length of the channel 62.

Figure 2:
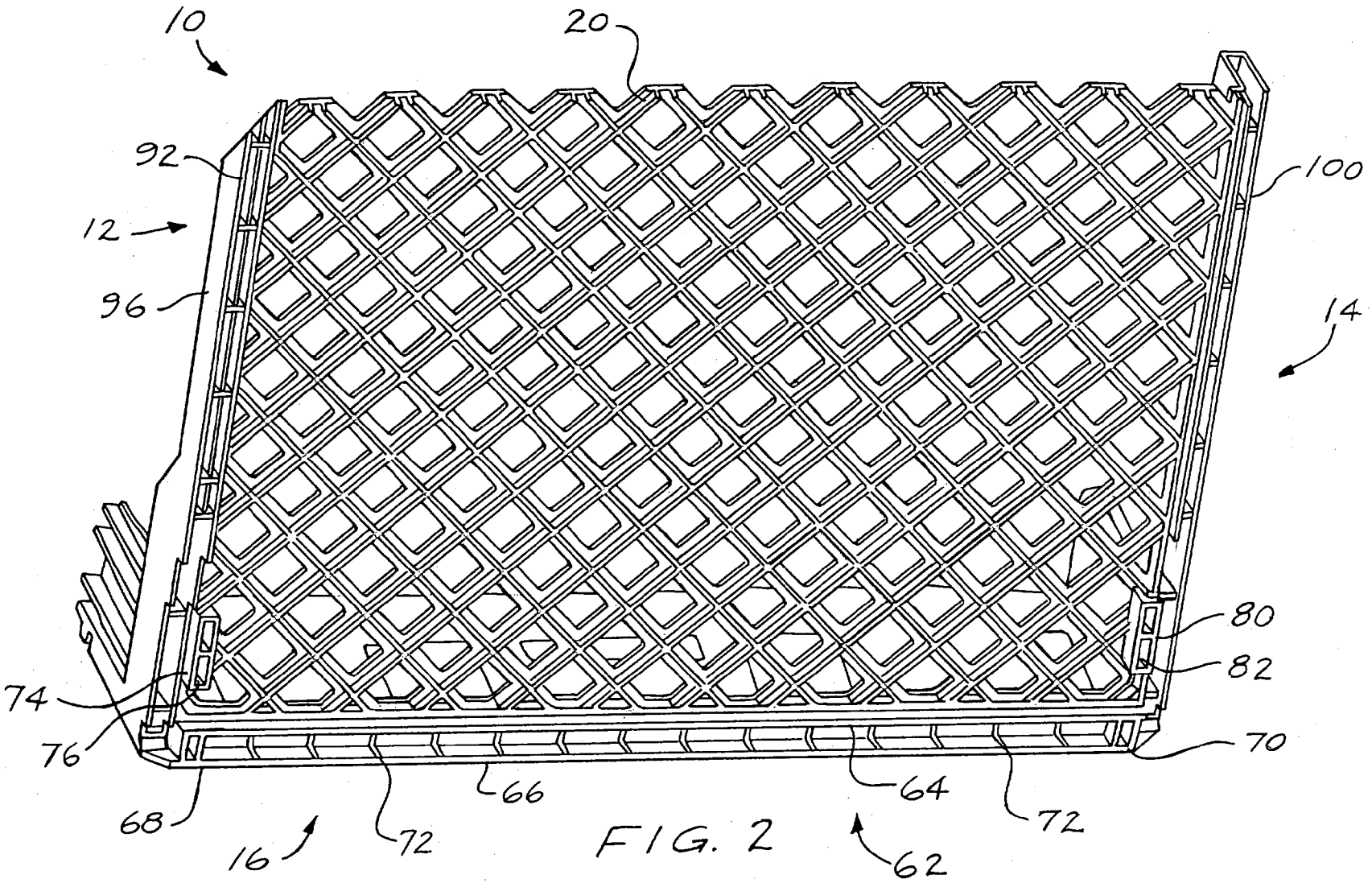
FIG. 2 is a partial perspective view of a bottom half of a tray according to the present invention.
Figure 4:
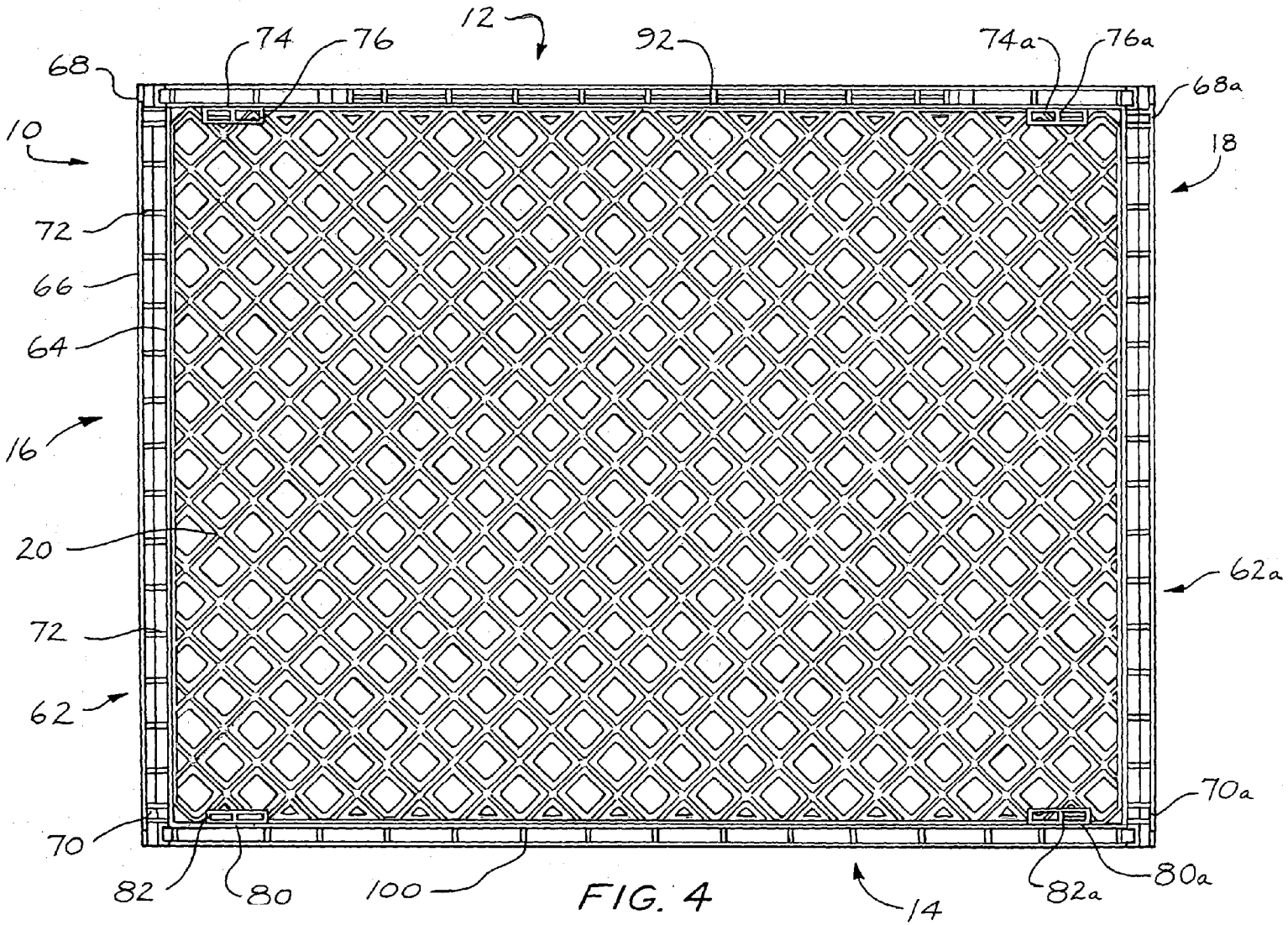
FIG. 4 is a bottom plan view of a tray according to the present invention.

When two trays 10 are stacked at an angle of 0° relative to one another, middle portion 54 of the bottom tray is positioned in the channel 62 of the top tray between the foot members 68 and 70. Also, foot members 68 and 70 of the top tray can be positioned in the first notch 58 and second notch 60, respectively, of the bottom tray. As best seen in FIGS. 1, 2 and 4, a surface 74 of a member 76 can be disposed adjacent an inwardly facing surface 78 of the front 12. A surface 80 of a member 82 can be disposed adjacent an inwardly facing surface 84 of the rear 14.

Two trays 10 can be stacked at an angle of 180° relative to one another. When two trays 10 are stacked at an angle 180° relative to one another, a middle portion 54*a* of the bottom tray can be positioned in the channel 62 of the top tray between foot members 68 and 70. The middle portion 54 of the bottom tray can be positioned in the channel 62*a* of the top tray between the foot member 68*a* and 70*a*. Foot members 68*a* and 70*a* of the top tray are positioned in the second notch 60 and first notch 58, respectively, of the bottom tray. A surface 74*a* of a member 76*a* can be disposed adjacent the inwardly facing surface 84 of the rear 14. A surface 80*a* of member 82*a* can be disposed adjacent the inwardly facing surface 78 of the front 12.

Two trays 10 can be stacked at an angle of 90° relative to one another. When two trays 10 are stacked at an angle 90° relative to one another, walls 64 and 66 can be supported with the surface 38 as well as one of the surfaces 25, 27. Two trays 10 stacked at an angle of 90° relative to one another define a height that is less than a height defined by two trays stacked at an angle of 180° relative to one another, or a height defined by two trays 10 stacked at an angle of 0° relative to one another. The highest stacking height is achieved when two trays are stacked at either one of an angle of 0° with respect to one another or an angle of 180° with respect to one another. The lowest stacking height is achieved when the trays are stacked at an angle of 90° with respect to one another.

The present invention provides a tray having prestressed sections to enhance stacking of the trays and the structural integrity of individual trays. Specifically, the present invention provides a dome, or arched bottom, and inwardly angled front corners, best seen in FIGS. 5, 7, and 8. The domed bottom and angled corners can reduce the likelihood that a tray will sag when material and/or product is loaded with respect to the tray.

Figure 5:
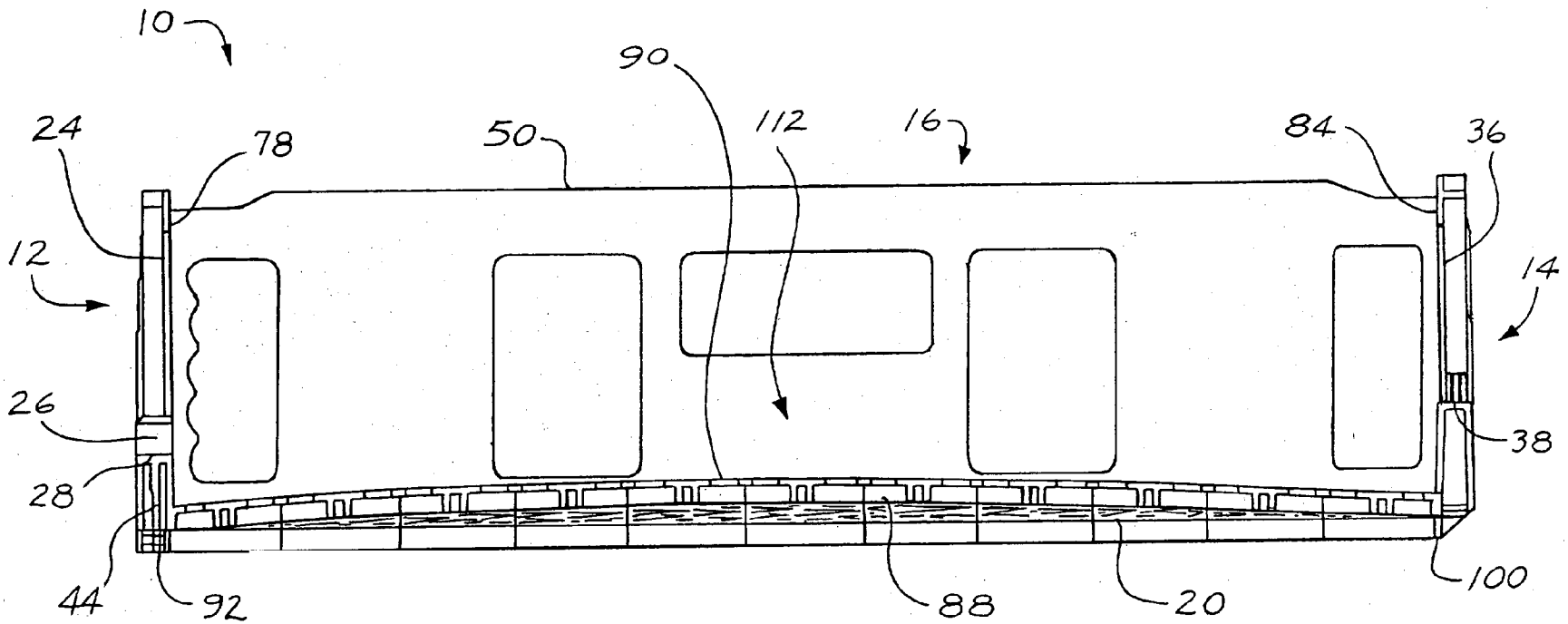
FIG. 5 is a cross-sectional view of a tray according to the present invention having a domed bottom.

Referring now to FIG. 5, a cross-sectional view of a tray 10 having a domed bottom is shown. The cross-sectional view is taken generally from the longitudinal axis 86 of the tray 10. The domed bottom 20 includes an outwardly facing surface 88 and an inwardly facing surface 90. The bottom 20 can include an arcuate profile in two substantially perpendicular directions, along the longitudinal axis 86 of the tray and along a transverse axis of the tray. Preferably, the dome is three-eighths (⅜) of one inch at the center of the bottom 20 in height. In other words, the center of the dome extends towards the interior of the tray 10 three-eighths (⅜) of one inch relative to the intersection of the bottom 20 with the first side 16, the second side 18, the front 12, or the rear 14. Where the bottom is partially domed, arched, or partially arched, the center of the dome can extend towards the interior of the tray 10 three-eighths (⅜) of one inch relative to the intersection of any of the bottom 20 with the first side 16, the second side 18, the front 12, or the rear 14. However, the height of the dome can be increased or decreased as desired. The height of the dome can be varied based on the weight of the material and/or products to be maintained in the tray 10.

Figure 7:
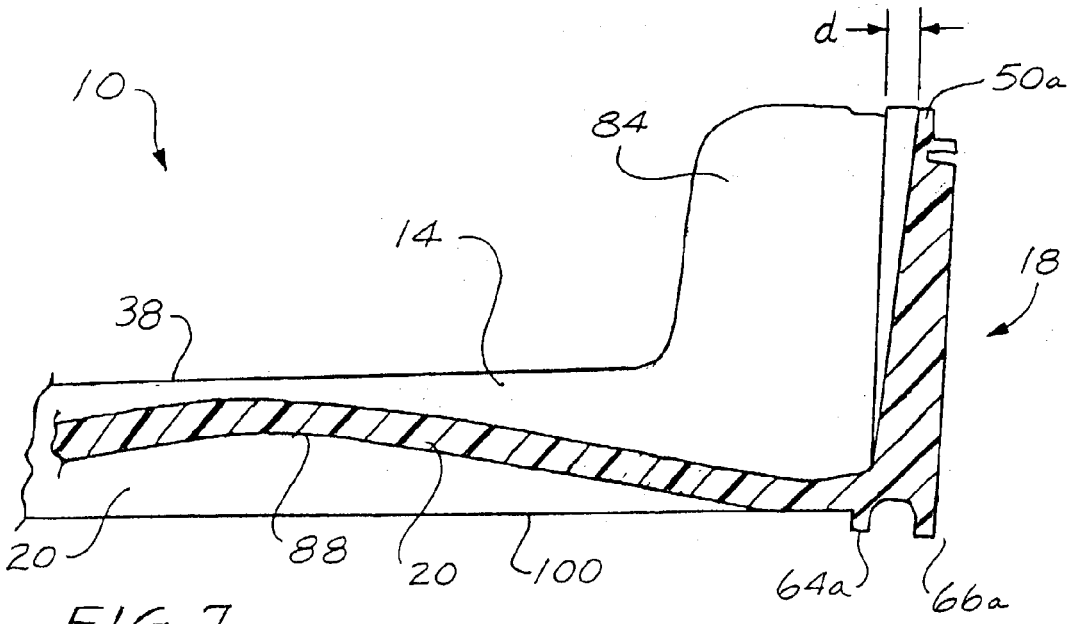
FIG. 7 is schematic cross-sectional view of a tray according to the present invention in a static or unloaded condition.

Referring now to FIG. 6, a portion 96*a* of the front 12*a* follows the profile of the partially-domed bottom 20*a*. The portion 96*a* can be centered with respect to the front between the first side 16*a* and the second side 18*a* and, more particularly, between the surfaces 26*a* and 30*a* to define a merchandising window. The bottom surface 92*a* of the front 12*a* along the portion 96*a* can be substantially parallel to the portion of the outwardly facing surface 88*a* of the bottom 20*a* adjacent the front 12*a*. The bottom 20*a* can engage the rear 14*a* of the tray 10*a* such that a bottom surface 99 of the rear 14*a* does not extend substantially parallel to the portion of the outwardly facing surface 88*a* of the bottom 20*a* adjacent the rear 14*a*. The top surface 28*a* of the portion 96*a* can extend substantially parallel to the bottom surface 92*a*. Preferably, the highest portion of the surface 28*a* can be one-half (½) of one inch higher than the center of the domed bottom 20*a*. FIG. 7 is a schematic view of the tray 10 in an unloaded or static condition. When the tray 10 receives material and/or goods to be maintained by the tray 10, the load 94 associated with the material and/or goods can deflect the tray 10 such that the surfaces 92 and 88, as well as the bottom 20, can be substantially horizontal, best seen in FIG. 8.

Figure 8:
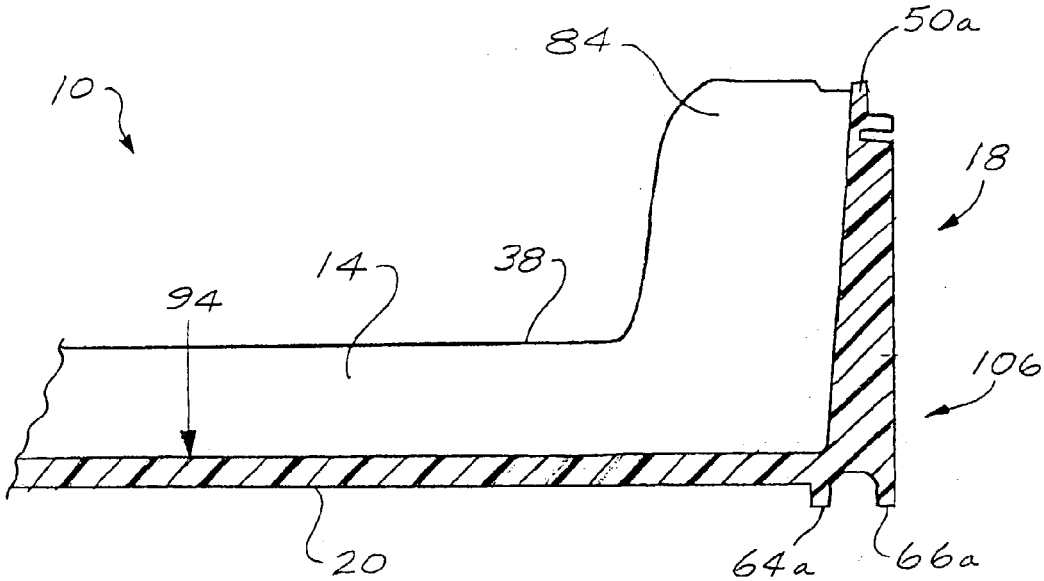
FIG. 8 is a schematic cross-sectional view of a tray according to the present invention in a loaded condition.

The present invention also provides outwardly angled front corners disposed between the front 12 and the first side 16, and the front 12 and second side 18, shown best in FIGS. 7 and 8. As shown in FIG. 7, a lower portion of the corner defined between the front (not shown) and the second side 18 can be angled inwardly toward a lower portion with respect to the tray 10 as the second side 18 extends from the rear 14 to the front (cut away). When material and/or products are received by the tray 10, represented by load arrow 94, the tray 10 can deflect such that the second side 18 adjacent the front is substantially horizontally aligned with the second side 18 adjacent the rear 14. Preferably, the horizontal transverse distance between the top portion of the second side 18 adjacent the rear 14 and the top portion of the second side 18 adjacent the front is one-half (½) inch. However, the distance d can be modified and be determined based on the material and/or product to be loaded with respect to the tray and the material of the tray. The walls 64*a* and 66*a* can be spaced apart to receive the runner 50*a* when the tray 10 is loaded or unloaded.

The tray 10 can include a front 12 having a first end 100, a second end 102 and first opening 22 disposed between the first and second ends 100, 102. The opening 22 can be substantially centered between the first and second ends 100, 102. The first opening 22 can be larger than the second opening 34. The first side 16 can extend from the first end 100 of the front 12, and a first corner 104 can be defined between the first side 16 and the front 12. The second side 18 can extend from the second end 102 of the front 12, and a second corner 106 can be defined between the second side 18 and the front 12. The rear 14 can include a first end 108 engageable with the first side 16 and a second end 110 engageable with the second side 18. The second opening 34 can be disposed between the first end 108 of the rear 14 and the second end 110 of the rear 14. The bottom 20 is operably associated with and extending between the front 12, rear 14, first side 16 and second side 18. The bottom 20 at least partially defines a dome 112 when the tray 10 is empty. The dome 112 is best shown in FIG. 5.

Referring now to FIG. 6, the opening 22*a* can include a surface 28*a* extending substantially parallel to at least a portion of the dome 112*a* defined by the bottom 20*a*. The surface 28*a* partially defines the opening 22*a*. When the tray 10*a* is empty, the surface 28*a* extends along an arcuate path. When the tray 10*a* is loaded, the surface 28*a* can become a substantially planar surface, flattening to be parallel with the dome 112*a* which also flattens when the tray 10*a* is subjected to a predetermined load, such as load 94 shown in FIG. 8. A surface 38*a* of the second opening 34*a*, defined by the rear, can be a planar surface when the tray 10*a* is supporting a predetermined load and when the tray is empty. A bottom portion 96*a* of the front 12*a* defines an arcuate surface 92*a* when the tray 10*a* is empty and a bottom portion 114 of the rear defines a substantially planar surface 99 when the tray 10*a* is empty.

In operation, when the tray 10 is subjected to a load, the lower ends of the first and second corners 104, 106 move away from one another, deflecting in response to the bottom 20 flattening into a more planar orientation. The channels 62 and 62*a* are sized to receive the first portions 52, 52*a* whether the tray 10 is loaded or empty. For example, when a bottom tray 10 is loaded, the front portions 52, 52*a* will be closer to one another than when the tray 10 is empty. The channels 62, 62*a* are sized to receive the front portions 52, 52*a* in both positions.

Third and fourth corners 120, 122 can be defined between the rear 14 and the first side 16 and the rear 14 and the second side 18, respectively. The third and fourth corners are spaced a predetermined distance apart from one another when the tray is loaded or empty. For example, the lower portions of the corners 104 and 106 move away from one another when the tray is loaded, however the third and fourth corners 120, 122 can be immovably associated with respect to one another.

When the tray 10 is loaded, at least a portion of one of the first and second sides 16, 18 can be twisted with respect to the bottom 20. For example, a top portion of the corner 106 can twist inwardly relative to the bottom 20 when the tray 10 is loaded, as best shown in FIGS. 7 and 8. A corresponding portion of the second side 18 adjacent the rear 14 can be fixed with respect to the bottom 20. As a result, an end of the second side 18 adjacent the front 12 can deflect and an end of the second side 18 adjacent the rear 14 can remain fixed and thus the second side 18 can twist when the tray 10 is subjected to a predetermined load 94. In addition, since the end of the second side 18 adjacent the rear 14 does not deflect and the end of the second side 18 adjacent the front 12 does deflect, the degree of deflection at any point along the length of the second side 18 increases along the length of the second side 18 from the rear 14 to the front 12.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A stackable tray comprising:

a bottom;

a front wall operably associated with the bottom, the front wall having a upper edge surface extending along an arcuate path when the tray is empty, the upper edge surface deflecting to form a substantially planar surface when a predetermined load is applied to the bottom of the tray; and a rear wall operably associated with the bottom, the rear wall having a horizontal upper edge surface defining a planar surface when the tray is empty and when the predetermined load is applied to the bottom of the tray.

2. The tray of claim 1, wherein the bottom at least partially defines a dome when the tray is empty and the upper edge surface of the front wall extends substantially parallel to at least a portion of the dome defined by the bottom.

3. The tray of claim 2, wherein the bottom and the upper edge surface of the front wall are substantially planar when the predetermined load is applied to the bottom of the tray.

4. The tray of claim 1, wherein the tray is stackable in two distinct heights, a highest stacking height defined when two like stacked trays are aligned in an identical orientation with respect to one another and when the two stacked trays are oriented rotated 180° with respect to one another, and a lowest stacking height defined when the two stacked trays are rotated 90° with respect to one another.

5. The tray of claim 1 further comprising a side wall operably connected to the bottom and having a first end operably connected to the front wall and a second end operably connected to the rear wall, the first end of the side wall movable between a first position when the tray is empty and a second position when the predetermine load is applied to the bottom of the tray, wherein in the first position the first end of the side wall is angled outward relative to the second end of the side wall and in the second position the first end of the side wall is aligned substantially parallel to the second end of the side wall.

6. The tray of claim 5 wherein the bottom at least partially defines a dome when the tray is empty and a substantially planar surface when the predetermine load is applied to the bottom.

7. A stackable tray comprising:

a bottom;

a front operably connected to the bottom;

a rear wall operably connected to the bottom; and a side wall having a first end operably connected to the front wall and a second end operably connected to the rear wall, wherein the first end of the side wall is angled outward relative the second end of the sidewall when the tray is empty, the first end of the sidewall deflecting so as to be aligned substantially parallel to the second end of the side wall when a predetermined load is applied to the bottom of the tray.

8. The tray of claim 7, wherein the front wall comprises a horizontally extending upper edge surface, wherein the upper edge surface extends along an arcuate path when the first end of the side wall is angled outward relative to the second end of the sidewall, and the upper edge surface is substantially planar when the first and second ends of the side wall are aligned substantially parallel to one another.

9. The tray of claim 7 further comprising a second wall operably connected to the bottom, the second wall having a first end operably connected to the front wall and a second end operably connected to the rear wall, wherein the second end of first wall and the second end of the second wall are aligned substantially parallel to one another when the tray is empty and when the predetermined load is applied to the bottom of the tray.

10. The tray of claim 7, wherein the bottom at least partially defines a dome when the tray is empty and a substantially planar surface when the predetermine load is applied to the bottom.

11. The tray of claim 10, wherein the front wall comprises an upper edge surface extending horizontally relative to the bottom of the tray, the upper edge surface of the front wall defining an arcuate path when the tray is empty and a substantially planar surface when the predetermine load is applied to the bottom of the tray; and the rear wall comprises an upper edge surface extending horizontally relative to the bottom of the tray, the upper edge surface of the rear wall defining a substantially planar surface when the tray is empty and when the predetermined load is applied to the bottom of the tray.

* * * * *